US006629860B1

(12) United States Patent
Hu et al.

(10) Patent No.: US 6,629,860 B1
(45) Date of Patent: Oct. 7, 2003

(54) ELECTRICAL CARD CONNECTOR WITH AN IMPROVED SHELL

(75) Inventors: Jinkui Hu, Kunsan (CN); ZiQiang Zhu, Kunsan (CN); ZhangLan Xue, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/315,848

(22) Filed: Dec. 9, 2002

(30) Foreign Application Priority Data

Sep. 25, 2002 (CN) ..... 091215146

(51) Int. Cl.[7] ..... H01R 9/03
(52) U.S. Cl. ..... 439/607; 439/159
(58) Field of Search ..... 439/159, 160, 439/607, 79, 630

(56) References Cited

U.S. PATENT DOCUMENTS

| | | | | | |
|---|---|---|---|---|---|
| 5,149,276 | A | * | 9/1992 | Dixon | 439/159 |
| 5,934,920 | A | * | 8/1999 | Ito et al. | 439/159 |
| 6,394,843 | B1 | * | 5/2002 | Chang et al. | 439/607 |
| 2002/0025726 | A1 | | 2/2002 | Nishimura | |

* cited by examiner

*Primary Examiner*—Tho D. Ta
(74) *Attorney, Agent, or Firm*—Wei Te Chung

(57) ABSTRACT

An electrical card connector (5) has a shell (1), a housing (2), a plurality of terminals (3) received in the housing and an ejector (4). The shell has a main body (10) and an extended portion (11) extending from one end of the main body, thus a memory card received in the eclectrical card connector may be fully shielded by the shell, and be prevented from being accidentally destroyed.

2 Claims, 3 Drawing Sheets

ELECTRICAL CARD CONNECTOR WITH AN IMPROVED SHELL

BACKGROUND OF THE INVENTION

1. Field of the Invention

The present invention relates to electrical card connectors used in electronic appliances such as a PDA (personal digital assistance) and digital cameras, more particularly, to a memory card connector with an improved shell receiving a micro memory card.

2. Description of the Related Art

Usually, a portable personal apparatus, such as a PDA or a digital camera, is provided with a memory card for storing data. It is necessary to arrange a connector to receive the memory card of the portable personal apparatus. Such connector usually has a metallic shell for avoiding electromagnetic interference (EMI). U.S. Pat. Pub. No. 2002/0025726, invented by Takeshi Nishimura published on Apr. 24, 2001, discloses a conventional card connector. The Nishimura connector includes a housing defining two slots, a plurality of first and second contact terminals respectively extending into corresponding slots. The slots are respectively arranged in upper and lower sides of the housing for receiving types of cards. The plurality of first and second contact terminals electrically connect with contact pads of the cards received in correspond slots.

However, the housing of the connector has a length much less than that of each electrical card received therein, thus the connector is not suitable for protecting a long electrical card, as a result, the card exposed of the housing is easy to be accidentally destroyed.

Hence, an electrical card connector with an improved shell is needed to overcome the foregoing shortcomings.

BRIEF SUMMARY OF THE INVENTION

A main object of the present invention is to provide an electrical card connector with a long shell for protecting a memory card receiving therein and ensuring an electrical connection between the card and contacts of the connector.

An electrical card connector mounted on a printed circuit board 7 (PCB) of an electronic appliance comprises a shell, a housing, a plurality of terminals received in the housing and an ejector. The shell has a main body and an extended portion extending from one end of the main body. The main body includes an upper plate, two side plates and an opening. The extended portion includes an upper wall, two lead side plates and a window. Thus a memory card received in the eclectrical connector may be fully shielded by the shell, and be prevented from being destroyed.

DETAILED DESCRIPTION OF THE INVENTION

Figure 1:
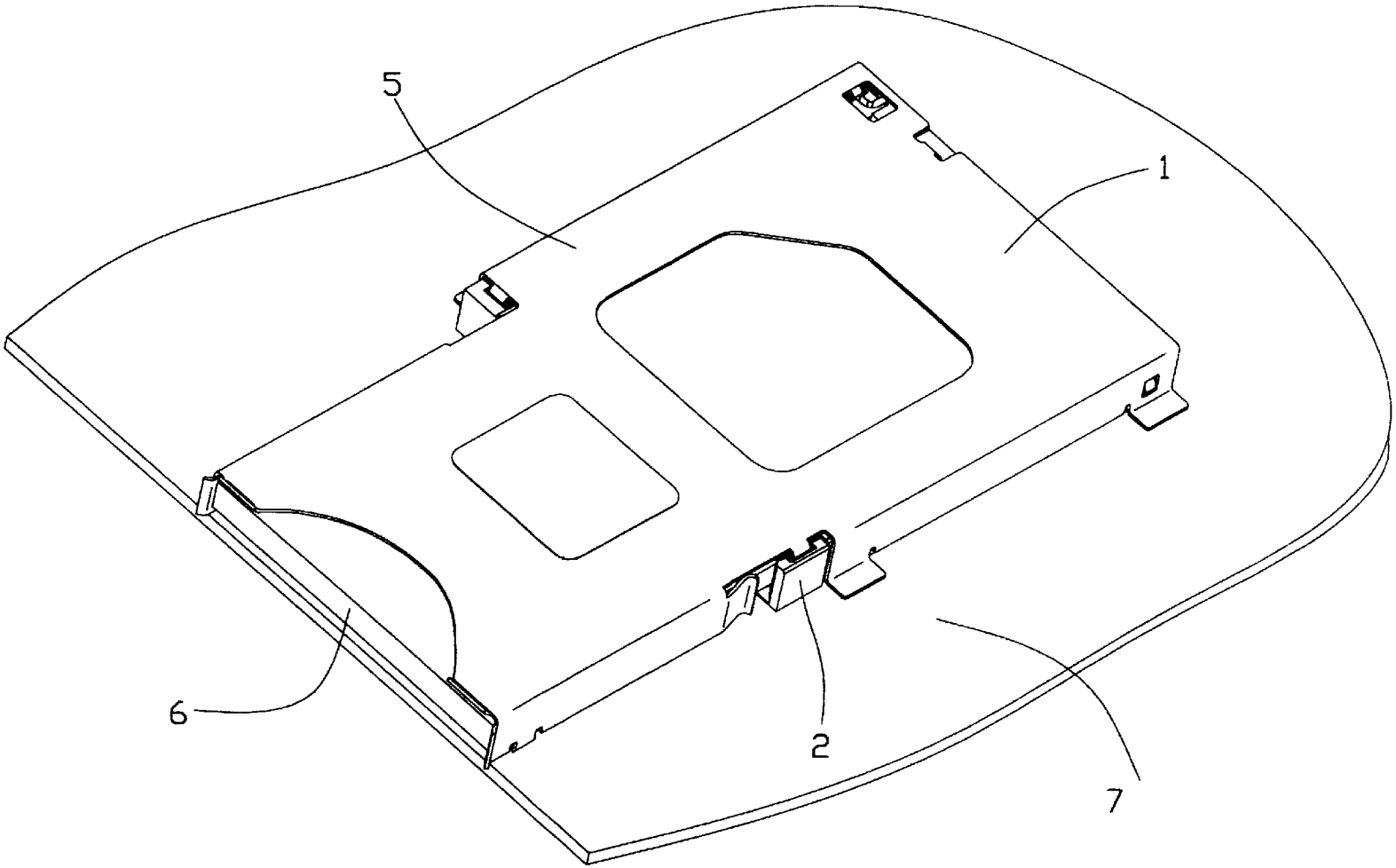
FIG. 1 is a perspective view of an electronic card connector mounted on a printed circuit board (PCB)according to the present invention.
Figure 2:
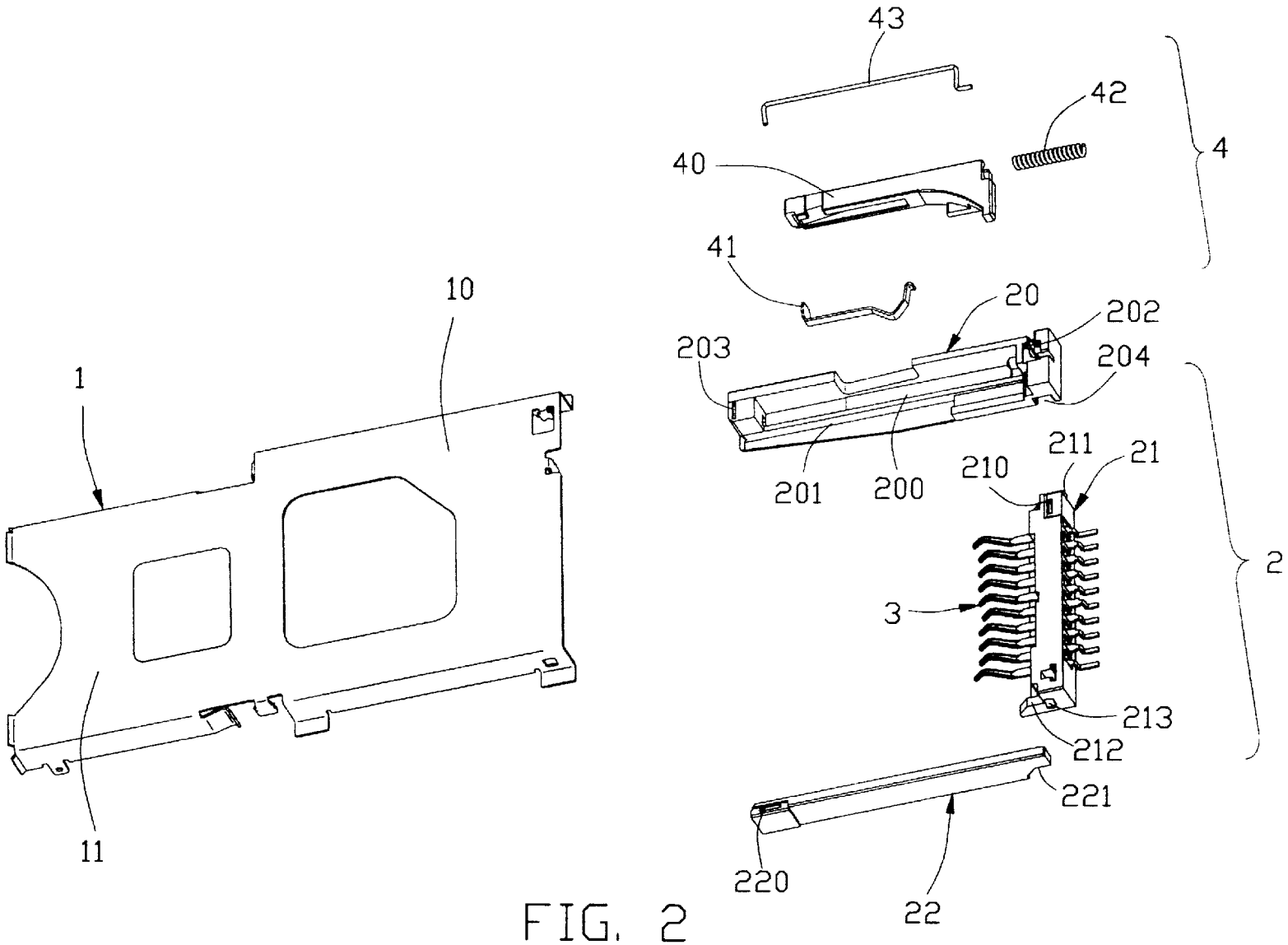
FIG. 2 is an exploded view of FIG. 1, wherein the PCB is removed away.
Figure 3:
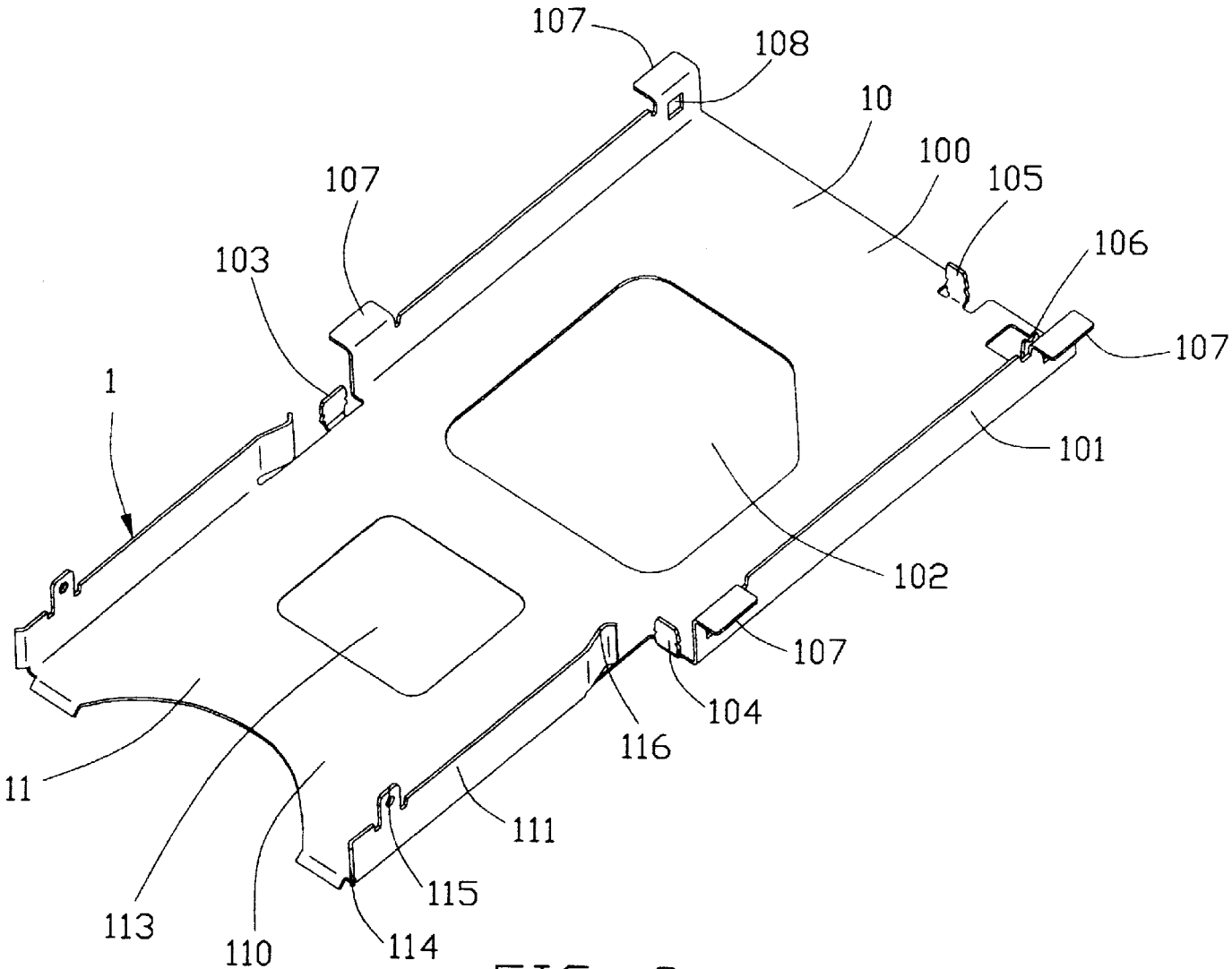
FIG. 3 is a perspective view of a shell according to the present invention.

Referring to FIGS. 1, 2 and 3, an electrical card connector 5 of the present invention is provided for mounted on a printed circuit board 7 (PCB) of an electronic appliance, such as a PDA or a digital camera. A memory card 6 is substantially received in the electrical card connector 5. The electrical card connector 5 includes a shell 1, an insulative housing 2, a plurality of terminals 3 received in the housing 2 and an ejector 4. The shell 1 includes a main body 10 and an extended portion 11 extending forwardly from the main body 10. The main body 10 is wider than the extended portion 11. The main body 10 is substantially rectangular-shaped having an upper plate 100, two side plates 101 respectively depending perpendicularly to the upper plate 100 and an opening 102 defined adjacent to the extended portion 11. The upper plate 100 of the main body 10 forms a first and second barbs 103, 104 at a front end thereof and a third and fourth barbs 105, 106 at a rear end thereof. The first and second barbs 103, 104 are formed adjacent to the extended portion 11. A plurality of cutouts 108 is defined in the side plates 101. A plurality of solder pads 107 depends downwardly from each side of the side plate 101. The extended portion 11 is substantially rectangular-shaped having an upper wall 110 and two lead side plates 111. The extended portion 11 defines a rectangular-shaped window 113. Each lead side plate 111 forms a first lead section 114 and a second lead section 116 respectively at a front and rear edges thereof. Each lead side plate 111 forms an engaging section 115 respectively extending therefrom and adjacent to the first lead section 114.

The insulative housing 2 includes a first rim 20, a second rim 22 and a rear rim 21. The first rim 20 includes an inner channel 201, a chamber 200, a second retaining hole 203, a fourth retaining hole 202 and a fixing hole 204. The second and fourth retaining holes 203, 202 are defined on opposite free ends of the first rim 20. The fixing hole 204 is defined in a bottom wall (not shown) thereof. The elongate rear rim 21 forms a first protrusion 211, a third fixing hole 210 adjacent to the first protrusion 211, a second protrusion 213 at an opposite free end thereof, and a tuber 212 adjacent to the second protrusion 213. The third fixing hole 210 is defined on a top wall (not labeled) of the rear rim 21. The second rim 22 includes a fixing hole 220 and an indentation 221. The first fixing hole 220 is defined in a front side of the second rim 22 corresponding to the first barb 103 of the shell 1. The indentation 221 is defined in the rear side of the second rim 22 corresponding to the tuber 212 of the rear rim 21.

The ejector 4 includes a slider 40, a spring contact 41, a spring 42 and a push bar 43. The structure and the function of the ejector 4 is well known to those skilled in the art, a detailed description is omitted herein.

In assembly, the ejector 4 is received in the chamber 200 of the first rim 20. The inner channel 201 of the first rim 20 is cooperating to slidably receive the memory card 6. The first rim 20 is received in the shell 1 thereby the second and fourth barbs 104, 106 respectively engaging with the second and fourth retaining holes 203, 202 of the insulative housing 2. The second rim 22 is received in the shell 1 and then the tuber 212 of the rear rim 21 engages with the indentation 221 of the second rim 22, the first fixing hole 220 engages with the first barb 103. The rear rim 21 is received in the shell 1 and then the first protrusion 211 engages with the fixing hole 204 of the rear rim 21, the third barb 105 is configured to engage with the third fixing hole 210 of the insulative housing 2 simultaneously. The second protrusion 213 engages with the cutout 108 of the side plate 101.

An advantage of the present invention over the prior art results from the fact that the shell 1 is long enough so that the card 6 received in the electrical connector 5 may be fully shielded by the shell 1 and be prevented from being accidentally destroyed.

The present invention also has other embodiments, the memory card 6 may be shorter than the shell 1 when received in the electrical card connector 5.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector assembly comprising: a printed circuit board;

an electrical connector mounted on a front edge region of the printed circuit board and including:

an insulative housing being far away from a front edge of said front edge region;

a plurality of terminals received in the housing;

an ejection mechanism located beside said housing and moveable along a front-to-back direction, said ejection mechanism being spaced from the front edge while being closer to said front edge than said housing; and a metal shell extending from said housing to the front edge, and enclosing both the housing and the ejection mechanism; wherein a front end of the ejection mechanism is essentially located around a middle portion of the shell: wherein a rear portion of said shell is larger than a front portion thereof for enclosing said ejection mechanism.

2. The assembly according to claim 1, wherein a front edge of the shell is substantially flush with the front edge of the printed circuit board.

* * * * *